US006726011B2

(12) United States Patent
Sarkar et al.

(10) Patent No.: US 6,726,011 B2
(45) Date of Patent: Apr. 27, 2004

(54) TOOTHBRUSH DISPLAY TRAY

(75) Inventors: Anand Sarkar, Mumbai (IN); Raju Ingale, Karad (IN)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/361,890

(22) Filed: Feb. 10, 2003

(65) Prior Publication Data

US 2003/0116459 A1 Jun. 26, 2003

Related U.S. Application Data

(63) Continuation of application No. 09/533,233, filed on Mar. 23, 2000, now abandoned.

(51) Int. Cl.[7] ..... B65D 83/10
(52) U.S. Cl. ..... 206/362.1; 206/469
(58) Field of Search ..... 206/362, 362.1, 206/362.2, 362.3, 461, 469, 471; D9/415

(56) References Cited

U.S. PATENT DOCUMENTS 3,288,280 A * 11/1966 Bostrom ..... 206/461
3,476,239 A * 11/1969 Jacob ..... 206/461
3,942,640 A * 3/1976 Hellstrom ..... 206/469
4,119,203 A * 10/1978 Kuchenbecker ..... 206/461
4,168,002 A * 9/1979 Crosby ..... 206/459.5
4,200,193 A * 4/1980 Boyle ..... 206/461
4,210,246 A * 7/1980 Kuchenbecker ..... 206/461
4,266,666 A * 5/1981 Kuchenbecker ..... 206/461
4,300,682 A * 11/1981 Kuchenbecker ..... 206/461
5,014,851 A * 5/1991 Wick ..... 206/539
5,154,293 A * 10/1992 Gould ..... 206/461
D408,278 S * 4/1999 Konop ..... D9/415

* cited by examiner

*Primary Examiner*—Shian Luong
(74) *Attorney, Agent, or Firm*—Michael J. McGreal

(57) ABSTRACT

The present toothbrush display tray provides a way to display toothbrushes in a horizontal orientation in a stacked vertical array. The display tray comprises a plastic layer with a plurality of recesses. A toothbrush is held in each recess and a sheet of material overlays the plastic layer and closes the toothbrush holding recesses. There is a series of perforation, serrations and/or slits around each packaged toothbrush so that each packaged toothbrush can be removed individually. The display tray also can have an information section above the product section. The display tray is made by forming a plurality of recesses, each to hold a toothbrush. Each recess is filled with a toothbrush and a sheet of material overlayed on the plastic layer and bonded to the plastic layer. Simultaneously or subsequent to bonding, the perforations are formed around each toothbrush to form individual toothbrush packages that are held in the display tray until removed by breaking the perforations, serrations and/or slits around a toothbrush package.

9 Claims, 3 Drawing Sheets

TOOTHBRUSH DISPLAY TRAY

This is a continuation of application Ser. No. 09/533,233 filled Mar. 23, 2000 now abandoned.

FIELD OF THE INVENTION

This invention relates to a tray to hold and display a plurality of toothbrushes. More particularly, this invention relates to a tray, and a method for making this tray, the tray to be in a vertical orientation to display the toothbrushes.

BACKGROUND OF THE INVENTION

Toothbrushes are displayed for sale in various ways. They can be hung form a rod and for that purpose each toothbrush package will have a notch or aperture at an upper end. The rod will be attached to a peg board for support. Another way to display toothbrushes at the point of sale is to use a rack such as is disclosed in Thailand Patent Application 52263. In this latter rack the toothbrushes are supported at a lower end. The brush that is to be purchased will be selected and lifted out of the rack. In yet another known display for packaged toothbrushes, the toothbrush packages are inserted horizontally into raised slots on each end of the toothbrush display tray. This latter display tray provides for a full view of the brush at the point of sale, however, the packaged toothbrushes must be assembled onto the display by hand. This is a costly and time-consuming packaging technique.

The present display technique solves the problem of a way to display packaged toothbrushes in a horizontal array in a cost efficient manner. In the present toothbrush display the packaging of the toothbrushes for display at the point of sale has been fully automated reducing the need for hand labor. Further, there is less waste in manufacturing this point of sale display packaging. This is a significant advantage when hand labor can be reduced and wastage reduced.

BRIEF SUMMARY OF THE INVENTION

This invention is directed to a display for toothbrushes at the point of sale and the method of making this display. The display holds the toothbrushes in a vertical orientation with each toothbrush in a separate package and in a horizontal orientation. The display is easier to use and can be constructed at a reduced cost.

The toothbrush display comprises a generally rectangular sheet of material having an upper section and a lower product display section. The product display section aids in holding a plurality of toothbrushes in a horizontal array. A plastic layer having a plurality of recesses the shape of a toothbrush is overlayed by the sheet of material and is attached to the sheet of material over the area of contact with the sheet of material. Around each of the toothbrushes which are held in a recess closed by the sheet of material, there is a weakened area provided by perforations, serrations and/or slits so that each packaged toothbrush can be removed separately. The sheet of material preferably will be a paperboard while the plastic layer preferably will be a thermoformable plastic. Further, in one preferred mode, the plastic layer substantially overlays the full sheet of material.

The toothbrush display tray is made by producing the plastic layer with a plurality of recesses, each recess being of a size and shape to accommodate a toothbrush. A toothbrush is placed into each recess and a sheet of material is layed over at least the section of the plastic layer which contains the toothbrush filled recesses, and then bonded to the plastic layer by adhesive or heat bonding. Simultaneous with or subsequent to the bonding, the perforations, serrations and/or slits are formed around each toothbrush. This forms an individual package for each toothbrush, and an individual package that can be removed from the array of packages by severing the perforations, serrations and/or slits around a particular toothbrush package. The individual toothbrush packages can be removed in any order.

The preferred method of bonding the plastic layer to the sheet of material is by heat bonding. In this method the sheet of material has an outer heat activated adhesive or plastic layer. Upon the sheet of material and plastic layer being brought into contact with pressure heat is applied to activate an adhesive or to soften a plastic surface of the sheet of material and of the plastic layer. This bonds the sheet of material to the plastic layer.

At the time of the perforations, serrations and/or slits being formed around each toothbrush, or prior to or after that time, an aperture can be formed adjacent an upper edge of the display tray so that the filled display tray can be hung from a hook or peg, either directly or indirectly at the point of sale.

In use a purchaser of a toothbrush will choose a toothbrush and remove this toothbrush from the display tray by severing the perforations around the chosen toothbrush.

DETAILED DESCRIPTION OF THE DRAWINGS

The invention will now be described in the preferred embodiments with reference to the drawings.

Figure 1:
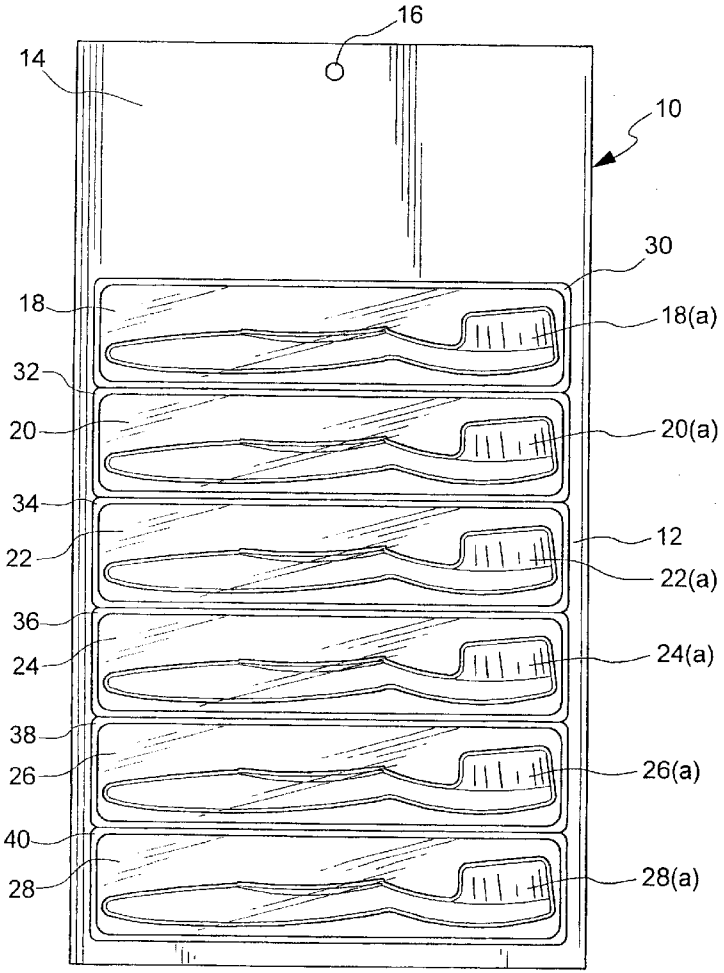
FIG. 1 is an elevational view of the toothbrush display tray as produced.

FIG. 1 shows a display tray 10 which is holding a plurality of toothbrushes 18(*a*), 20(*a*), 22(*a*), 24(*a*), 26(*a*) and 28(*a*). These are in separate packages 18, 20, 22, 24, 26 and 28. The display tray is comprised of lower product section 12 and upper informational area 14. The upper informational area will carry the product name, a description of the toothbrushes, and in some instances, suggested pricing. This upper informational area also can have an aperture 16 from which the display tray can be hung from a peg holder, either directly or indirectly. Indirectly a string can be laced through the aperture and tied into a loop. The looped string then can be suspended by a holder.

Figure 2:
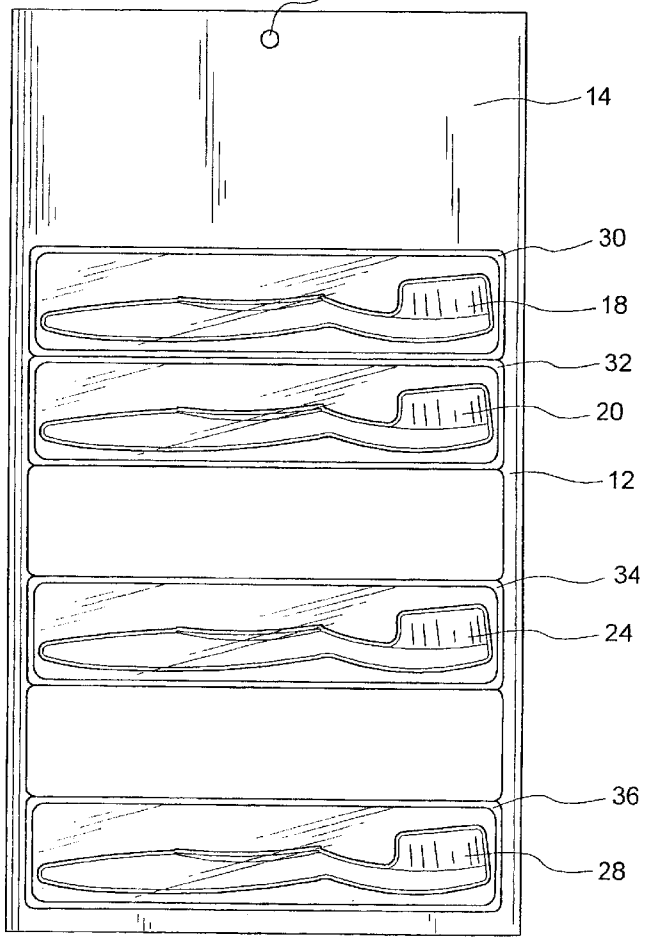
FIG. 2 is an elevational view of the toothbrush tray with two toothbrushes removed.

Each of the toothbrush packages 18, 20, 22, 24, 26 and 28 is surrounded by a weakened area 30, 32, 34, 36, 38 and 40 respectfully. This weakened area is provided by a plurality of perforations, serrations and/or slits. Any one of the packaged toothbrushes can be removed. Packaged toothbrushes 22 and 26 are shown removed in FIG. 2.

Figure 3:
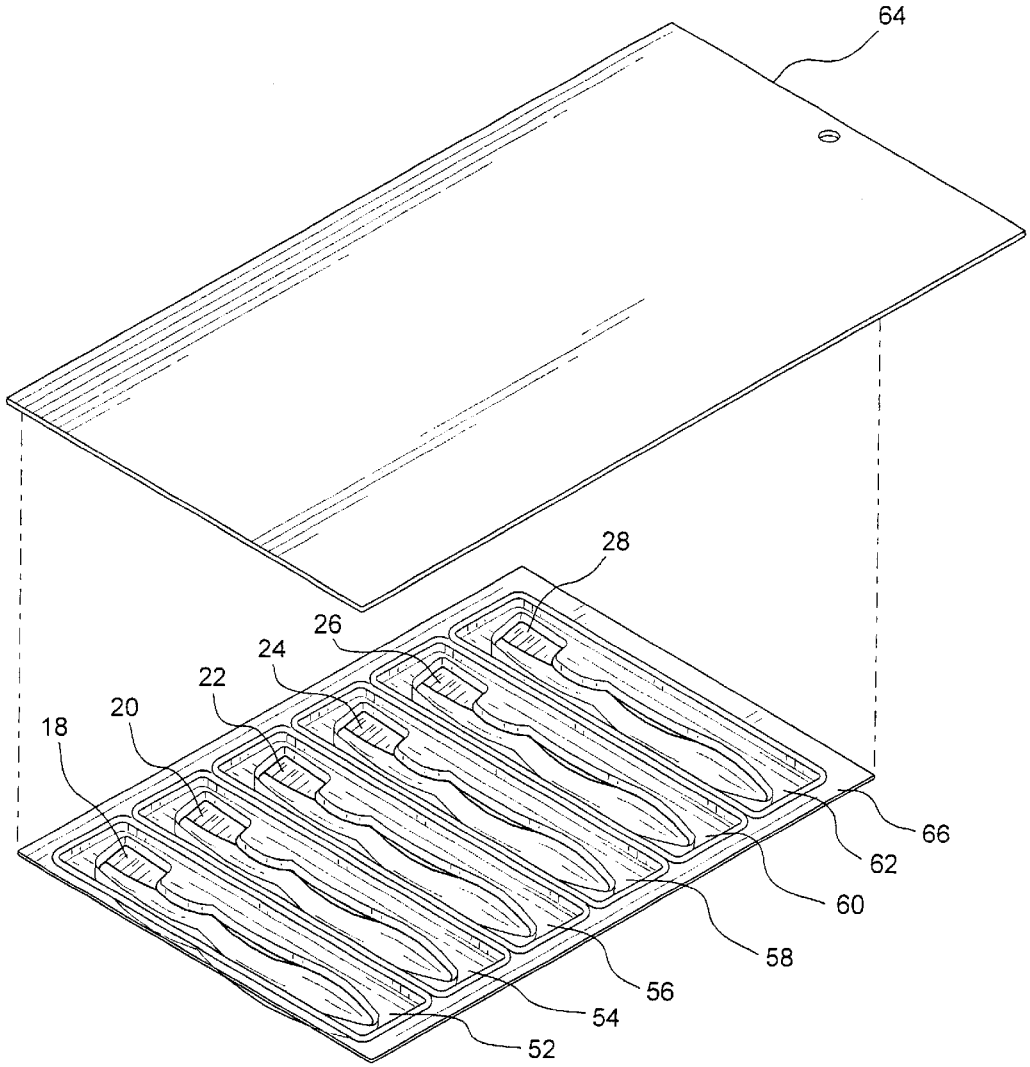
FIG. 3 is an exploded view of the toothbrush display tray of FIG. 1.

FIG. 3 shows the components in an exploded view. There is seen here a plastic layer of material 66 with a plurality of recesses 52, 54, 56, 58, 60 and 62. These recesses contain toothbrushes 18, 20, 22, 24, 26 and 28 respectfully. The sheet of material 64 then is overlayed on this plastic layer 66. The recesses in the plastic layer can be made by thermoforming or a similar molding process. The sheet of material can be essentially the same size as the product holding section of the plastic sheet of material or as shown it can extend beyond the product holding section of the plastic layer. Further the plastic layer can be of the same length as the sheet of material when the sheet of material has a product description section 14.

Figure 4:
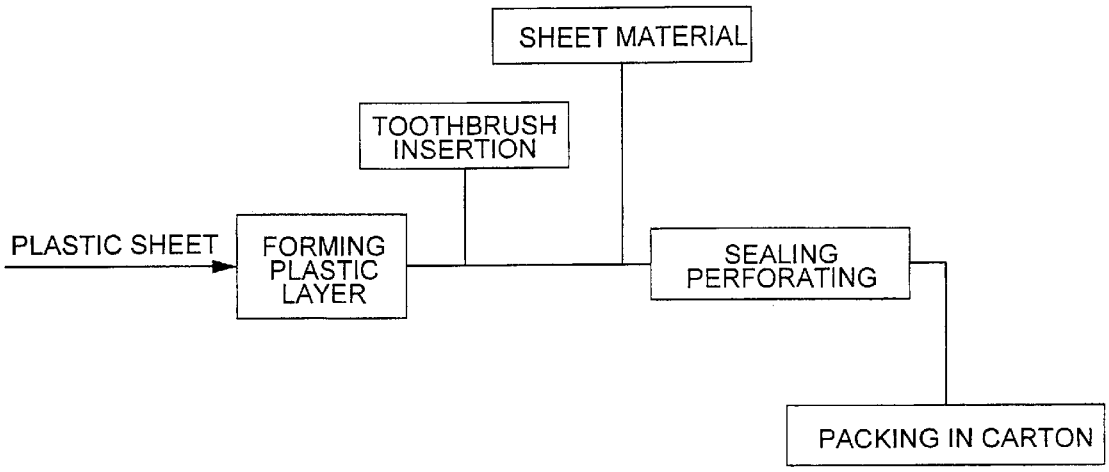
FIG. 4 is a schematic view of the process of making the toothbrush display tray.

FIG. 4 describes the process for producing the display tray. A planar plastic layer is fed to a forming station where it is thermoformed to have a plurality of recesses. Each of the recesses is adapted to hold a toothbrush. At the next station a toothbrush is dropped into a recess and the sheet of material is placed over the plastic layer. In the next station the sheet of material and the plastic layer holding the toothbrushes are heat bonded together. In this same station perforations, serrations and/or slits are formed through the sheet of material and plastic layer and substantially around each of the toothbrushes where the sheet of material and plastic layer are in contact. This produces a weakened area and makes it possible to remove each packaged toothbrush individually. Also, at this time, the aperture 16 can be formed. The display trays then go directly to cartoning.

The sheet of material can be a plastic, paperboard or a paperboard having an adhesive coated onto, or a plastic laminated to, the surface that is to be bonded to the plastic layer. Preferred adhesives are heat activated or ultraviolet cured adhesives. A plastic layer will be a polyene such as polyethylene, polypropylene, polybutadiene or an acrylic-betadiene-styrene (ABS). The plastic layer is preferably a polyene such as polyethylene, polypropylene, polybutadiene, or an ABS, polyvinyl chloride or polyethylene terephthalate.

The present toothbrush display tray can be modified in various ways. However, any such modifications are within the concept described in this specification.

What is claimed is:

1. A toothbrush display tray comprising a generally rectangular sheet of material having an upper section and a lower product section, said product section having a plurality of toothbrushes associated therewith, a plastic sheet layer overlaying and attached to a substantial portion of said sheet of material, said plastic sheet layer in said product section having a plurality of recesses, each recess surrounded by a planar peripheral area of said plastic layer and said sheet of material, and of a size to accommodate at least one of said plurality of toothbrushes, said sheet of material and said plastic layer being weakened around the full periphery of each of said recesses whereby one or more packaged toothbrushes may be independently removed from the display tray leaving an aperture surrounded by said planar peripheral area of said plastic layer and sheet of material thereby not affecting the remaining toothbrushes which will be maintained in the same position in the display tray by its surrounding planar peripheral area.

2. A toothbrush display tray as in claim 1 wherein said sheet of material is a paperboard.

3. A toothbrush display tray as in claim 1 wherein said plastic sheet layer is comprised of a transparent plastic.

4. A toothbrush display tray as in claim 3 wherein said plastic sheet layer is selected from the group consisting of polyethylene, polypropylene, polybutadiene, or acrylic-butadiene-styrene, polyvinyl chloride or polyethylene terephthalate.

5. A toothbrush display tray as in claim 1 wherein adjacent the upper end of said upper section, there is an aperture whereby said display tray may be suspended by a suspending means utilizing said aperture.

6. A toothbrush display tray as in claim 1 wherein said plastic sheet layer overlays and is attached to less than the entire upper section.

7. A toothbrush display tray as in claim 1 wherein said plurality of toothbrushes comprises about 6 to 15 toothbrushes.

8. A toothbrush display tray as in claim 1 wherein said weakened periphery is comprised of a plurality of perforations.

9. A toothbrush display tray as in claim 1 wherein said weakened periphery is comprised of a plurality of slits.

* * * * *